United States Patent [19]

Waldrum

[11] Patent Number: 4,844,345

[45] Date of Patent: Jul. 4, 1989

[54] ASPIRATOR TRAY

[76] Inventor: John E. Waldrum, 349 Fairview Ave., Ambler, Pa. 19002

[21] Appl. No.: 186,362

[22] Filed: Apr. 26, 1988

[51] Int. Cl.[4] ..... B05B 1/28

[52] U.S. Cl. ..... 239/121; 239/124

[58] Field of Search ..... 239/120–122, 239/104; 137/312, 313; 134/104; 118/301

[56] References Cited

U.S. PATENT DOCUMENTS

| | | | |
|---|---|---|---|
| 1,985,482 | 12/1934 | Chapin et al. | 118/301 |
| 2,512,542 | 6/1950 | Goda | 118/301 |
| 2,584,650 | 2/1952 | Woodruff | 239/121 |
| 3,027,870 | 4/1962 | Schirmer | 118/301 |
| 4,168,798 | 9/1979 | Moore et al. | 239/121 |
| 4,255,922 | 3/1981 | Hiyama et al. | 239/121 |
| 4,431,382 | 2/1984 | Edman et al. | 239/121 |
| 4,760,963 | 8/1988 | Waldrum | 239/245 |

FOREIGN PATENT DOCUMENTS

| | | | |
|---|---|---|---|
| 0058215 | 5/1979 | Japan | 239/121 |

*Primary Examiner*—Andres Kashnikow
*Assistant Examiner*—Karen B. Merritt
*Attorney, Agent, or Firm*—Steele, Gould & Fried

[57] ABSTRACT

An aspirator tray for connection to a liquid chemical spray device is disclosed. The tray includes a floor surrounded by a peripheral flange to define a dripped liquid chemical receiving and storage area. The tray connects to the spray device below the spray nozzles and is configured of sufficient size to catch any liquid chemical that may drip or dribble from the spray nozzles. A bottom drain opening is provided through the tray floor and vacuum tubing interconnects the drain opening with the top of the liquid chemical storage tank. A venturi is positioned with the main chemical supply outlet at the tank in a manner to provide suction forces through the vacuum tubing at all times when the spray device is in operation. In this manner, all liquid chemical materials caught by the tray will be automatically and continuously returned to the storage tank.

6 Claims, 1 Drawing Sheet

ASPIRATOR TRAY

BACKGROUND OF THE INVENTION

1. Field of the Invention

This invention relates generally to spray devices for applying liquids to ground surfaces from a moving vehicle, and more particularly, the invention relates to an improved spray device for mounting upon a wheeled carrier for applying low volumes of agricultural chemicals such as pesticides and plant growth regulators in a manner to prevent dribble from the applicator and subsequent plant burn.

2. Discussion of the Prior Art

There are a number of known types of spray devices which are available for the ground application of various types of treatment liquids, such as herbicides, insecticides, fungicides, fertilizers, plant growth regulators and other agricultural chemicals. Most often, such applications are accomplished by the use of suitable spray nozzles which may be mounted upon vehicles through an intermediate boom or extension device. A chemical storage tank of suitable capacity is mounted upon the vehicle and is in fluid communication with the spray nozzles whereby the nozzles can be directed to apply the product upon either a generally horizontal spray target area, such as golf course turf or farm growing areas or on generally vertically extending target spray areas, for example, the shrubbery and other growth that can be present immediately adjacent to the lateral edges of vehicular highways.

One suitable spray device for this purpose has been developed by the present applicant and forms the subject matter of a copending patent application entitled "Ground Spray Applicator", filed July 15, 1986, Ser. No. 885,773, now U.S. Pat. No. 4,760,963.

The previously available agricultural spray devices, including the device described in the said copending patent application all generally exhibited a common problem in that the nozzles exhibited a tendency to drip or dribble during spraying whereby droplets or an accumulated amount of liquid chemical composition could be developed at the spray nozzles and could be dripped directly upon the ground surface, rather than be distributed as part of a uniform fine spray mist pattern. Normally speaking, when the spray target area comprised a relatively rough or unfinished area, for example the lateral edges of most highways, then the inherent dribble attendant with the spray equipment was either not noticeable or not of sufficient consequence to require any changes in the equipment. However, when the spray target area comprised an agriculturally improved and finished area, for example, the fairways and greens of a golf course, then such dribble was both noticeable and unacceptable. Prior workers in the art have become aware of the unacceptable nature of the spray dribble when the liquid chemical droplets settled to the ground. The droplets would then apply an increased concentration of liquid chemical product upon a greatly decreased agricultural surface than would normally be encountered when the material was delivered in the usual fine spray or mist configuration. Such chemical concentration could easily burn or otherwise damage the effected turf areas, thereby killing the grass in a highly visible manner that was entirely unacceptable and inexcusable.

Additionally, following completion of a spraying operation, the main chemical supply valve was then normally or electrically functioned to close the valve. The valve closure usually resulted in trapping a small quantity of liquid chemical in the hose or hoses intermediate the chemical storage tank and the spray nozzles. This trapped material could often escape through the nozzles to thereby fall upon the ground in concentrated form, to additionally cause unintentional grass burn. While such dribble or dripping could be considered to be inherent in the usual spray apparatus of the type currently available for agricultural chemical delivery, and even though there must be a small amount of liquid chemical inherently remaining in the hoses after shut off of the main supply valve, the need remains to find a simple solution to the dribble problem to prevent damage to finished grass areas.

SUMMARY OF THE INVENTION

The present invention relates generally to ground spray applicators for applying liquid agricultural chemicals, and more particularly, is directed to an aspirator tray suitable for underfitting currently available spray nozzle equipment to catch all dribble and drips which may result from the chemical spraying operation in a manner to automatically deliver the liquid chemical back to the chemical storage tank without permitting any liquid droplets to reach the ground.

The aspirator tray of the present invention includes a connector arm for bottomly affixing the tray to the spray equipment being used. The tray includes generally a planar floor to receive and retain any dribble from the spray equipment and the floor is configured to extend sufficiently beyond the outer periphery of the spray equipment to assure that all dripped material will enter the tray. A peripheral retaining flange surrounds the tray floor and is fabricated of sufficient height to retain the necessary quantity of liquid chemical product therewithin. Sufficient liquid storage volume is described into the tray configuration to prevent overflow over the top of the peripheral flange whereby any finished grass areas could be severely and probably permanently damaged by the liquid chemical.

It should be noted that the aspirator tray of the present invention is particularly suitable for use with vehicles and spray equipment designed to apply agricultural chemicals over an expanse of generally level ground, for example, the fairways and greens of a conventional golf course. Accordingly, the spray device will normally be retained in vertical position to apply a horizontal spray pattern over the grass surfaces. The floor of the aspirator tray is therefore designed to be maintained generally in horizontal orientation whereby any liquid chemical received in the tray will be retained therein. The aspirator tray of the present invention is not designed or intended for use when the spray equipment is rotated for vertical spray application (for example during highway plant growth regulator application) and accordingly, should not be so employed.

The floor of the aspirator tray is provided with a bottomly positioned drain opening whereby all liquid chemical received within the tray will be directed to an exit path from the tray through the said bottom opening. A length of vacuum tubing connects to the bottom opening and extends from the tray to the main supply outlet fitting which is usually positioned at the top of the chemical storage tank. This permits the liquid chemical received within the tray to be delivered automatically back to the spray equipment through the spray nozzles. The tank top fitting can be modified as necessary to receive the outlet end of the vacuum tubing. A venturi is associated with the vacuum tubing outlet and is positioned within the main supply fitting in a known manner to develop a vacuum within the vacuum tubing. When spray nozzles are in operation and quantities of liquid chemical are being drawn through the tank top fitting for delivery to the spray nozzles, a vacuum will be developed in the vacuum tubing at its connection to the tray. The constant vacuum created at the aspirator tray bottom opening during all normal periods of spraying operation will automatically and continuously cause any liquid dribble which may accumulate in the tray to automatically be delivered back into the tank without any chance of tray overflow or spillage. Even after the spraying operation has been discontinued and there may be a small amount of liquid remaining in the spray equipment or tubing after the main valve has been closed, such liquid material will be received on and retained within the aspirator tray and will not be thereby permitted to drip heedlessly directly upon the ground surface. Upon resumption of the spray operation, the vacuum developed in the vacuum tube will again function to automatically empty the material retained within the aspirator tray construction.

It is therefore an object of the present invention to provide an improved aspirator tray for spray equipment of the type set forth.

It is another object of the present invention to provide a novel aspirator tray for use with agricultural chemical spray equipment that comprises means to securely affix the tray bottomly to the spray equipment, means to receive any dribble or drip from the spray equipment, means to receive any dripped liquid chemicals within the confines of the tray itself and means to automatically deliver any liquid dribble directly back to the chemical storage tank.

It is another object of the present invention to provide a novel aspirator tray for spray equipment including a generally planar floor, a peripheral flange surrounding the planar floor to define a dripped liquid chemical storage area therewithin, a liquid chemical drain opening provided in the bottom of the tray floor, a tube interconnecting the drain opening with a fitting at the top of the chemical storage tank amd venturi means within the storage tank top fitting to provide a constant vacuum at the tray drain opening during all periods of spray nozzle operation.

It is another object of the present invention to provide a novel aspirator tray for spray equipment that is inexpensive in manufacture, easily installed upon existing spray equipment and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

DESCRIPTION OF THE PREFERRED EMBODIMENT OF THE INVENTION

Figure 1:
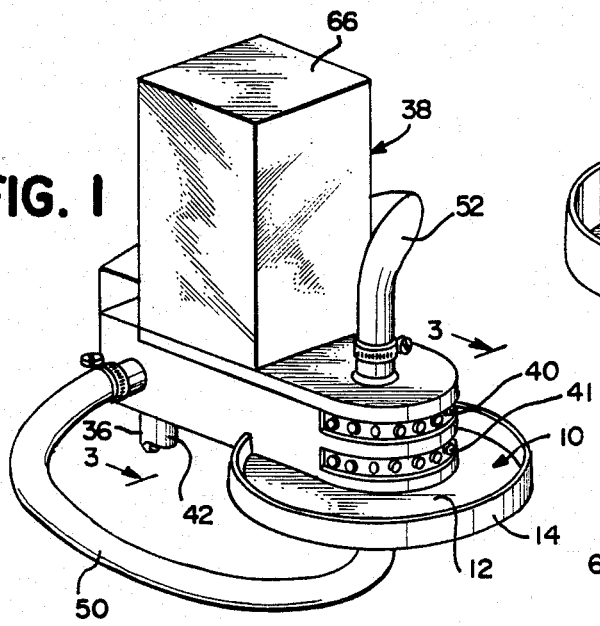
FIG. 1 is a perspective view showing the aspirator tray of the present invention in place beneath a known spray nozzle array.

Although specific terms are used in the following description for the sake of clarity, these terms are intended to refer only to the particular structure of the invention selected for illustration in the drawings, and are not intended to define or limit the scope of the invention.

Figure 2:
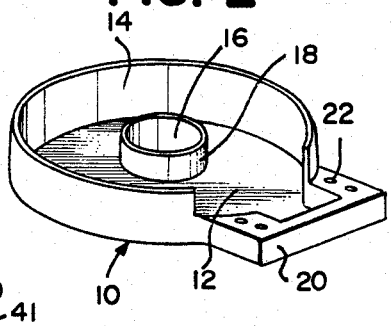
FIG. 2 is a perspective view of the aspirator tray of the present invention.
Figure 3:
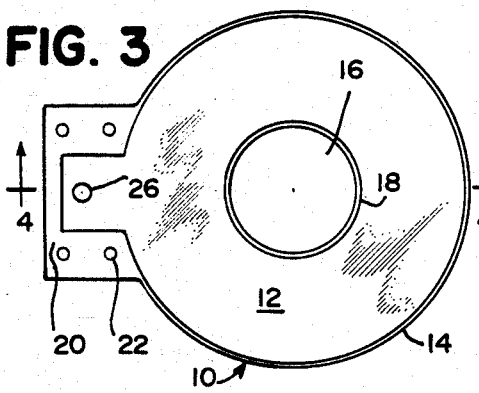
FIG. 3 is a top plan view of the aspirator tray looking from line 3—3 in FIG. 1.
Figure 4:
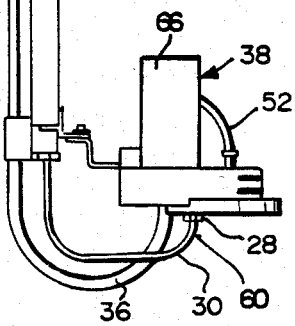
FIG. 4 is a cross sectional view of the aspirator tray taken along line 4—4 in FIG. 3.
Figure 4:
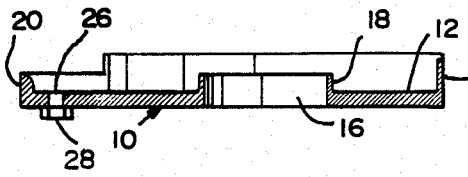

Referring now to the drawings, there is shown in FIGS. 2 and 3 an aspirator tray 10 which is shown in FIG. 1 in association with a known type of spray device 38, for example a ground spray applicator as disclosed and described in said U.S. patent application Ser. No. 885,773 now U.S. Pat. No. 4,760,963. The applicator tray includes an integral connector arm 20 for bottom connection to the spray device 38 and the connector arm is preferably provided with a plurality of spaced bolt openings 22 to receive conventional connector bolts in a manner to secure the tray 10 to the bottom of the spray device 38 in a sturdy,structurally secure, substantially leak-proof interconnection.

As shown, the aspirator tray 10 comprises a generally planar floor area 12 that extends horizontally beyond the outer periphery of the spray nozzles 40, 41 of the spray device 38 whereby all drips and dribble which may be associated with or caused by the use of the spray device 38 will fall by gravity vertically downwardly and will be received and retained upon the tray floor 12. A peripheral flange 14 surrounds the floor 12 so that all received liquid materials will be retained within the tray and will not be permitted to laterally exit the tray to inadvertently drop upon the ground below (not shown). The flange 14 should be fabricated of a sufficient height to provide an adequate storage volume sufficient to receive and retain all liquid chemical that may reasonably be expected to accumulate during the spraying operation. This will include all material which may be positioned within the spray equipment hoses immediately after pump shutdown whereby such excess liquid material will not be permitted to inadvertently fall upon the ground.

As shown, the aspirator tray includes a central opening 16 which may be provided with a retaining flange 18 of suitable size to prevent leakage or overflow at the central opening. The central opening 16 receives the bottom supply hose 50 of the existing spray device 38 therethrough in a manner not to interfere with the normal operation of the device 38.

The floor 12 of the aspirator tray 10 is provided with a liquid chemical drain opening 26 of suitable size to permit complete drainage of any spilled material that may be collected within the tray itself. In the illustrated embodiment, the drain opening 26 is shown within the connector arm 20 of the aspirator tray 10. However, it will be appreciated that the opening 26 can be located in any suitable position as may be advantageous to completely drain any material which may collect upon the tray floor 12. A conventional drain fitting 28 bottomly overfits the drain opening 26 in known manner to connect the inlet end 60 of the small diameter drain vacuum tube 30. The vacuum tube 30 extends in length as necessary along the existing spray device articulating arm 58 to reach the top outlet 62 of the chemical storage tank 32. Prior workers in the art have generally employed such spray devices 38, articulating arms 58, main supply tubing 36 and storage tanks 32 in conjunction with wheeled vehicles (not shown) in order to most efficiently apply the material being sprayed to the desired target area.

Figure 6:
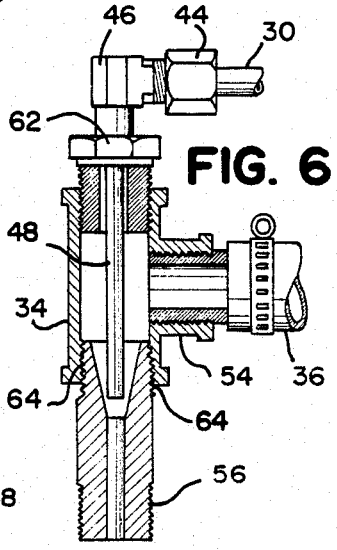
FIG. 6 is an enlarged, detailed view partly in section, showing the venturi arrangement at the tank top fitting.

The outlet end 44 of the drain vacuum tube 30 terminates at the main fitting 34 provided at the top of the liquid chemical storage tank 32 and is connected through a suitable threaded outlet angle fitting 46 in known manner. As best seen in FIG. 6, the outlet fitting 46 communicates with a conventional venturi 48 which is positioned in the main outlet flow from the tank 32 by employing a threaded nipple 56. The tank top fitting 34 is configured in the form of a T-fitting and includes a connection inlet 64 to receive the nipple 56 and a main outlet 54 to which the inlet to the main spray supply hose 36 can be connected in a known leak-proof manner. Accordingly, when the spray device pump 66 is activated to cause the spraying of liquid chemicals through the upper and lower nozzles 40, 41, liquid will flow through the nipple 56 and through the main outlet 54 to simultaneously automatically cause functioning of the venturi 48 in usual manner. This in turn will apply the suction forces generated by the venturi directly at the tray drain opening 26, which opening has previously been described as connecting the drain vacuum tube 30 through the bottom drain fitting 28.

Figure 5:
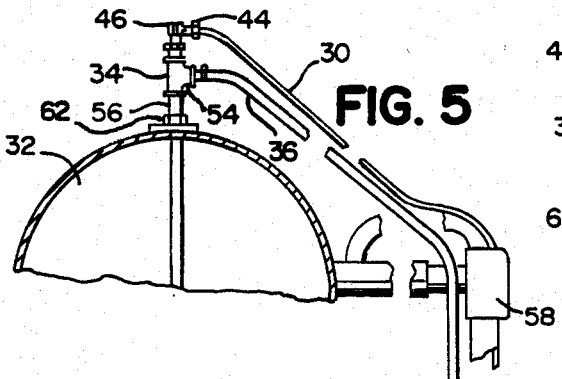
FIG. 5 is a partial piping system as showing the piping arrangement for the aspirator tray.

In operation, upon functioning of the pump 66, liquid chemicals from within the tank 32 will be pumped out of the tank through the tank top fitting 34. The liquid chemicals will then be pumped under pump pressure through the fitting outlet 54 and through the main supply tube 36 for delivery to the spray device 38. See FIG. 5. As been seen in FIG. 1, the main liquid chemical stream (not shown) from the main supply tube 36 can be divided within the spray device 38 to flow through the bottom nozzle supply hose 50 and the top nozzle supply hose 52 for subsequent spraying through the pluralities of lower nozzles 41 and upper nozzles 40. The spray device articulating arm 58 affixes to the vehicle (not shown) in known manner to raise and lower the spray device 38 in vertical alignment without tilting, also in well known manner, to apply a controlled spray pattern upon a selected target area, such as a golf course.

Any excess liquid which may accumulate at the nozzles 40, 41 will naturally form into liquid chemical droplets and will fall by gravity directly into the aspirator tray 10. Additionally, upon completion of the spraying operation, any liquid chemical that may remain within the spray device 38, within the main supply tube 36 or within the upper and lower nozzle supply hoses 52, 50 that may have a tendency to drip or dribble from the apparatus by gravity through the nozzles 40, 41 will similarly be caught by the floor 12 of the tray 10 to prevent dropping directly upon the vegetation below. The liquid materials entering the tray 10 will be retained therein by the interior and exterior peripheral flanges 18, 14 for eventual flow to the tray drain opening 26. As above set forth, upon operation of the pump 66 and the spray nozles 40, 41, the natural function of the venturi 48 will cause suction forces to be applied at the tray bottom opening 26. Any liquid chemical delivered through the bottom opening 26 will be carried through the drain vacuum tube 30 for subsequent flow back into the tank 32 through the vacuum tube outlet and outlet fitting 44, 46. In this manner all excess, leaked, chemical liquid will be continuously and automatically returned to the liquid storage tank 32 without being permitted to fall upon the ground.

Although the invention has been described with a certain degree of particularity, it is understtod that the present disclosure has been made only by way of examinple and that numerous changes in the details of construction and the combination and arrangement of parts may be resorted to without departing from the spirity and scope of the invention. Thus, the scope of the invention should not be limited by the foregoing specification, but rather, only by the scope of the claims appended hereto.

What is claimed is:

1. An aspirator tray for underfitting the spray nozzles of agricultural spray apparatus of the type comprising a liquid chemical storage tank, a spray device including the nozzles and a main supply tube leading the liquid chemicals from the storage tank to the spray device comprising a liquid impervious tray affixed to the spray device below the spray nozzles, the nozzles spraying the liquid chemicals in a generally horizontal spray pattern, the tray being located entirely below the spray pattern and the spray nozzles, the tray comprising a floor and a peripheral first flange rising above the floor, the first flange defining a liquid retaining means to retain any liquid chemical material that may dribble from the spray nozzles, the first flange terminating below the spray nozzles, the first flange having a height that is less than the height of the spray nozzles above the floor;

a bottom drain opening provided in the tray floor to drain any liquid material that may be received in the tray;

vacuum tubing means interposed between the liquid chemical tank and the tray to drain all liquid from the tray floor; and means to deliver the liquid from the tray floor to the liquid chemical storage tank.

2. The aspirator tray of claim 1 wherein the main supply tube connects to the liquid chemical storage tank through a fitting and wherein the said vacuum tubing means comprises a length of tubing having an outlet end, the outlet end being connected to the said fitting in juxtaposed relation to the main supply tube connection.

3. The aspirator tray of claim 1 wherein the spray apparatus further includes a spray nozzle supply hose and wherein the tray floor is provided with an opening, the opening being of size and position to receive a portion of the spray nozzle supply hose therein.

4. The aspirator tray of claim 3 and an interior, second flange rising above the tray floor, the second flange surrounding the opening to prevent leakage of liquid chemical through the opening.

5. The aspirator tray of claim 4 wherein the height of the second flange above the floor is less than the height of the spray nozzles above the floor.

6. The aspirator tray of claim 1 wherein the spray nozzles are arranged in semi-circular alignment and wherein the tray comprises a semi-circular portion positioned beneath the spray nozzles, the radius of the tray semi-circular portion being greater than the radius of the semi-circular spray nozzle alignment.

* * * * *